US005528963A

United States Patent [19]

Wei

[11] Patent Number: 5,528,963

[45] Date of Patent: Jun. 25, 1996

[54] RATCHET HAND TOOL

[76] Inventor: Hung-Yin Wei, No. 21, Lane 225, Taiping Road, Taiping Hsiang, Taichung Hsien, Taiwan

[21] Appl. No.: 399,038

[22] Filed: Mar. 6, 1995

[51] Int. Cl.[6] ..... B25B 13/46

[52] U.S. Cl. ..... 81/63; 81/438; 81/63.2

[58] Field of Search ..... 81/438, 439, 177.5, 81/63, 63.2, 60, 61, 62

[56] References Cited

U.S. PATENT DOCUMENTS

| | | | |
|---|---|---|---|
| 916,620 | 3/1909 | Shaul | 81/62 |
| 4,341,293 | 7/1982 | Acevedo | 81/63.1 |
| 4,367,664 | 1/1983 | Ekshtut | 81/439 |
| 4,926,721 | 5/1990 | Hsiao | 81/439 |
| 5,142,953 | 9/1992 | Lin | 81/63 |
| 5,144,869 | 9/1992 | Chow | 81/63.2 |
| 5,309,798 | 5/1994 | Markwart et al. | 81/438 |
| 5,392,672 | 2/1995 | Larson et al. | 81/60 |

*Primary Examiner*—Bruce M. Kisliuk
*Assistant Examiner*—Joni B. Danganan
*Attorney, Agent, or Firm*—Bacon & Thomas

[57] ABSTRACT

A ratchet hand tool including a stop plate and an urging element for controlling clockwise or counterclockwise of a ratchet being provided on two base plates which may be grip with the hand. One end of the ratchet is provided with a joint element having a ball and an elastic ring. A rotary element is fitted onto the joint element. When a longitudinal rod is inserted into the joint element to urge against the ball inside the joint element, the ball displaces outwardly to expand the elastic ring, which in turn urges tightly against the rotary element. In cooperation with a polygonal hole of the rotary element, the longitudinal rod is caused to turn when the rotary element is rotated, so that screws may be driven in or out quickly.

8 Claims, 8 Drawing Sheets

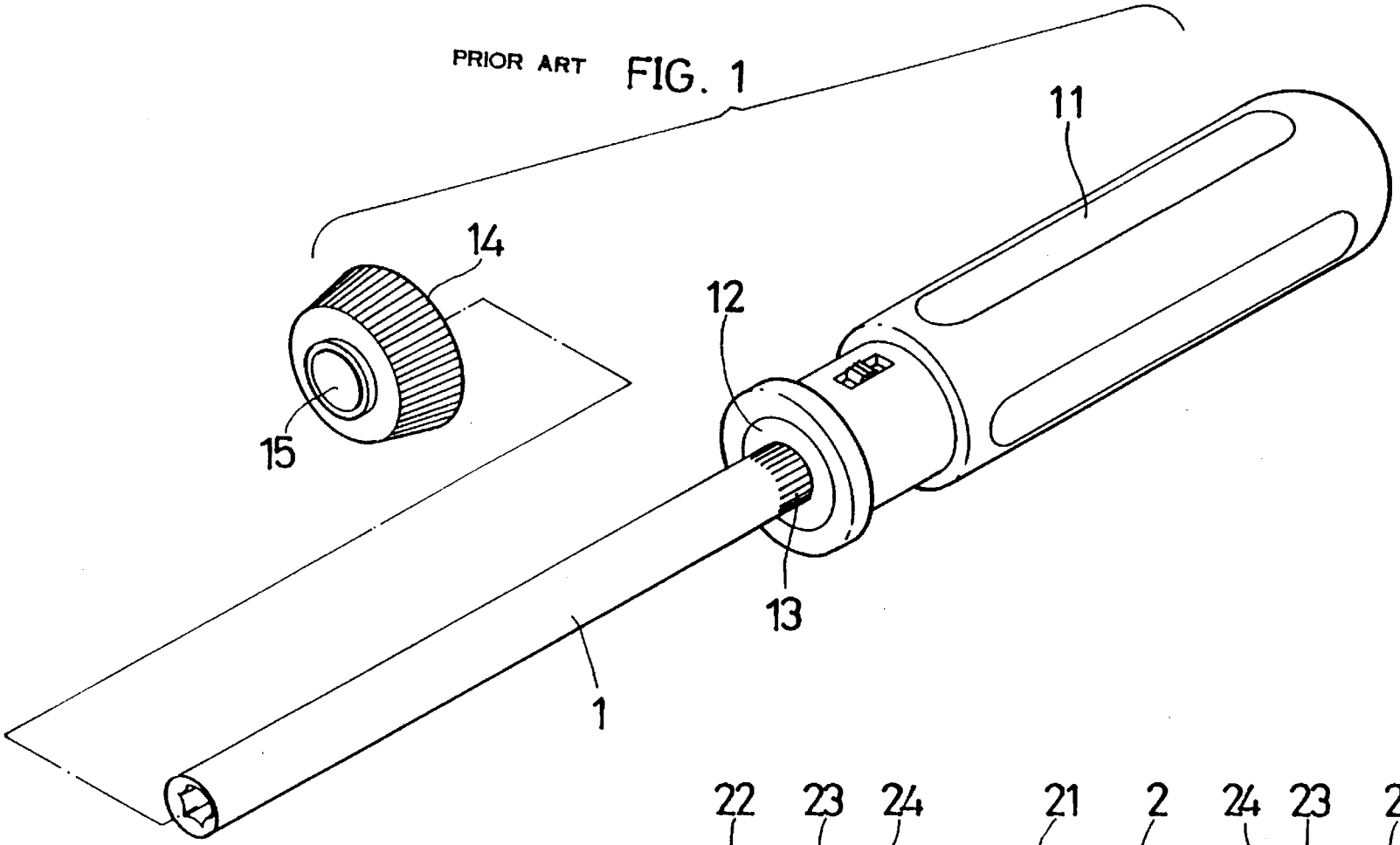
PRIOR ART FIG. 1
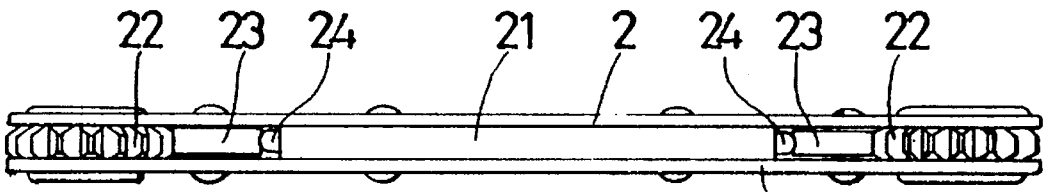
PRIOR ART FIG. 2

RATCHET HAND TOOL

BACKGROUND OF THE INVENTION

1. Technical Field

The present invention relates generally to a ratchet hand tool, and more particularly to a ratchet hand tool provided with a rotary element for speedy driving actions.

2. Description of the Prior Art

With reference to FIG. 1, a prior ratchet driver comprises a shank 1, a handle 11 and a ratchet mechanism 12 installed in the handle 11, the ratchet mechanism being capable of driving the shank 1 to rotate in a single direction. A threaded portion 13 is provided on the shank 1 adjacent the handle 11, and a cylindrical auxiliary handle 14 is fitted onto the threaded portion 13. The auxiliary handle 14 is inserted via a hole 15 in the center of its second end onto the threaded portion 13 and is tightly secured therewith. By rotating the auxiliary handle 14 of the shank 1 to enhance the driving force in driving screws, the shank 1 may be driven unidirectionally to speedily drive a screw in or out. However, this kind of ratchet driver cannot provide a greater torque for tightening the screw securely.

A known ratchet wrench is shown in FIG. 2. This known ratchet wrench comprises two driving elements 2 which are divided by a partition 21. An end of each of the driving elements 2 is provided with a ratchet 22. The ratchets 22 at both ends thereof are respectively restricted by a stop plate 23 which is urged against by an urging element 24, thereby any one of the ends of the wrench may be held by the hand for driving screws with the other end thereof. This kind of ratchet wrench structure may provide a greater torque, but it is not suitable for use in screwdrivers, and cannot provide quick driving actions.

SUMMARY OF THE INVENTION

Therefore, the primary object of the present invention is to provide a ratchet hand tool, wherein a rotary element is securely fitted to a ratchet joint so that by rotating the rotary element, a longitudinal rod inserted into the ratchet joint may be brought to turn quickly for driving screws.

BRIEF DESCRIPTION OF THE DRAWINGS

The foregoing and other features and advantages of the present invention will be more clearly understood from the following detailed description and the accompanying drawings, in which, FIG. 1 shows a conventional ratchet driver;

FIG. 2 shows a conventional ratchet wrench;

DETAILED DESCRIPTION OF THE PREFERRED EMBODIMENT

Figure 3:
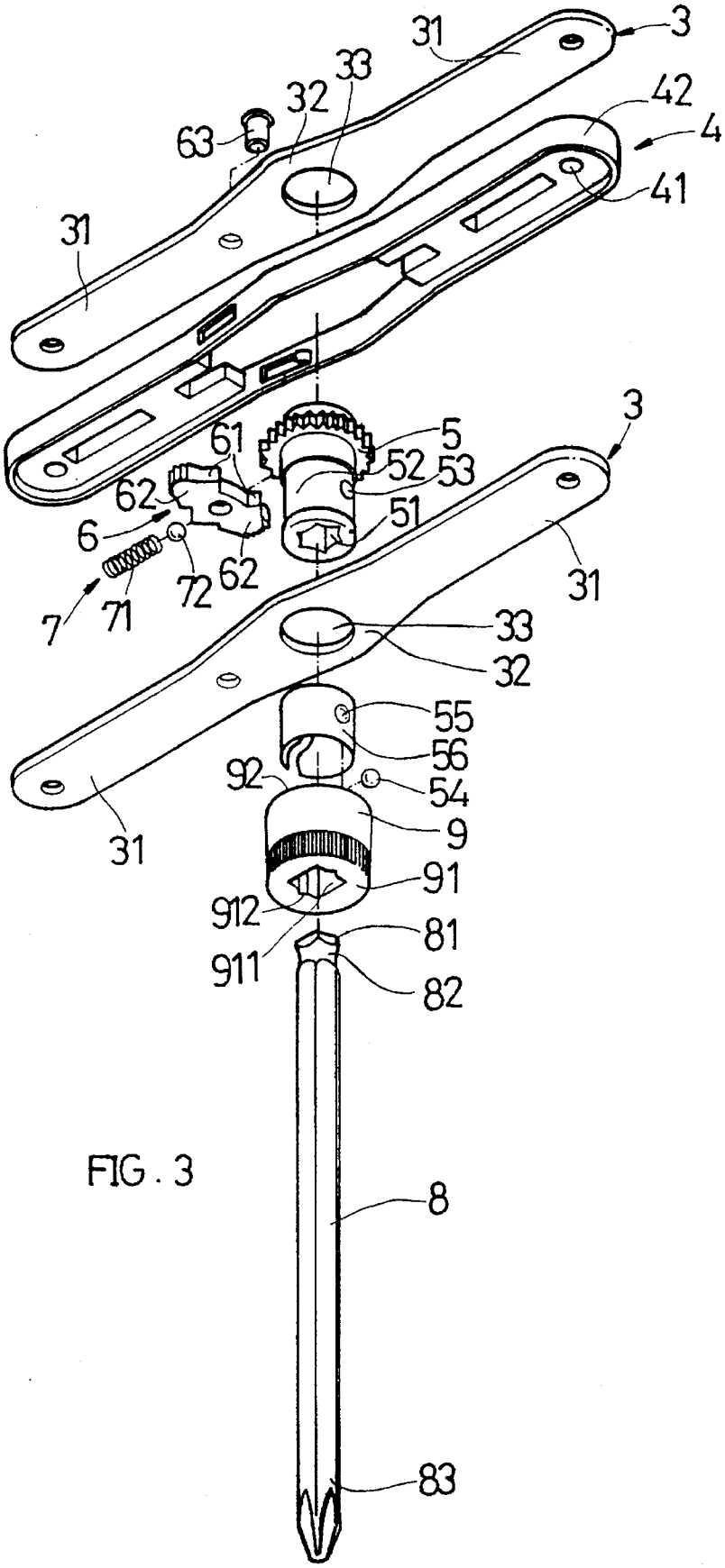
FIG. 3 is a perspective exploded view of a first preferred embodiment of the present invention.
Figure 4:
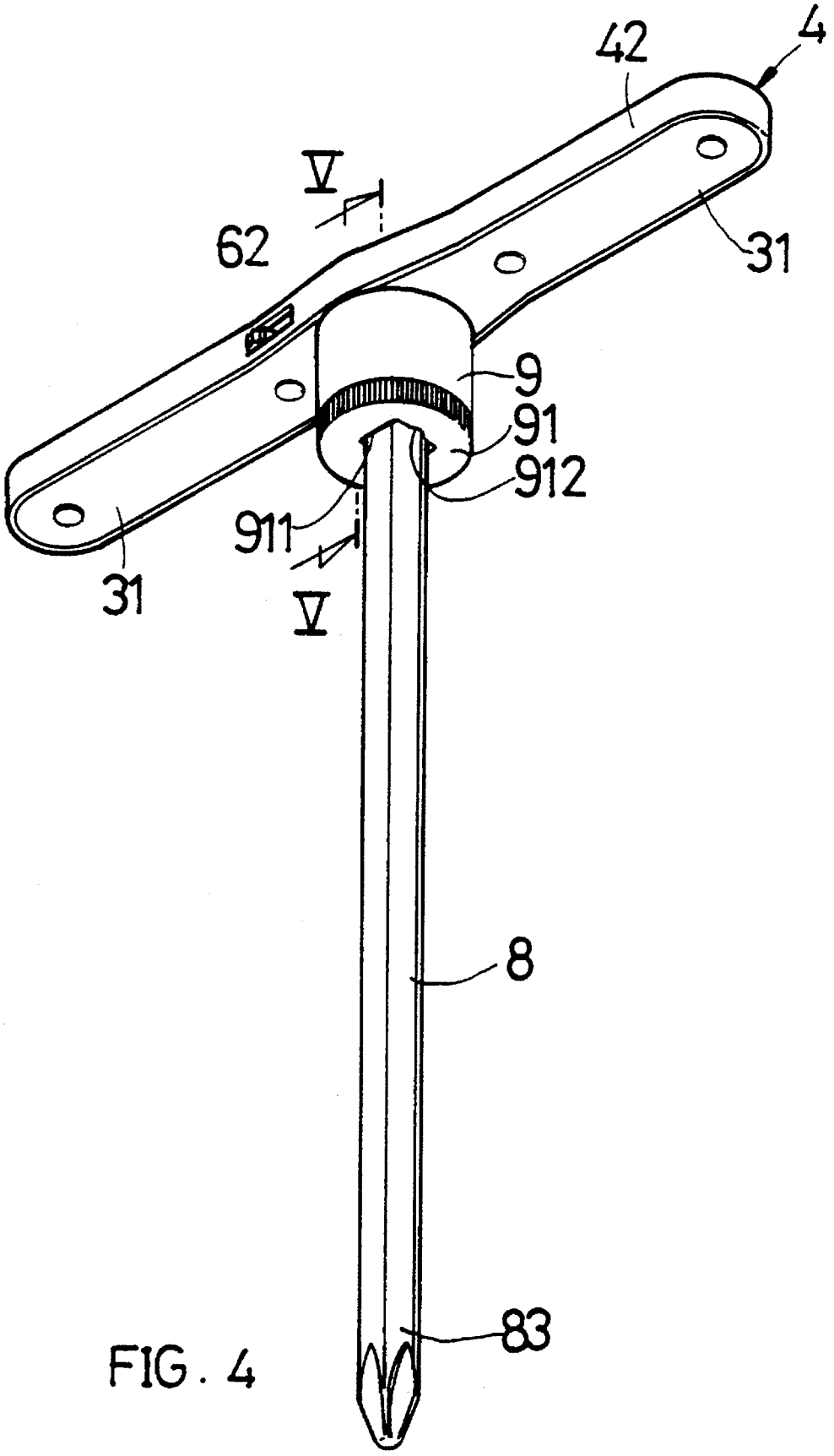
FIG. 4 is a perspective view of the first preferred embodiment of the present invention after assembly.

With reference to FIGS. 3 and 4, the first preferred embodiment of the ratchet hand tool according to the present invention comprises two base plates 3, a base 4, a ratchet 5, a stop plate 6, an urging element 7, a longitudinal rod 8 and a rotary element 9. Both ends of each of the base plates 3 are respectively provided plate-like handles 31. The two handles 31 of each base plate 3 are connected by a connecting portion 32 which is integrally joined to the handles 31. The base 4 is disposed between the two base plates 3, and they are united in a level position with one on top of the other. The base 4 has a multiplicity of through holes 41 and a protecting flange portion 42 extending upwardly and downwardly from the rim of the base 4 for enveloping the base plates 3 above and below the base 4. Each connecting portion 32 of each base plate 3 has a circular hole 33, and the ratchet 5 is disposed in the circular holes 33 of the connecting portions of the two base plates 3. The ratchet 5 has a joint element 52 with a longitudinal hole 51 and which extends longitudinally through the circular hole 33 of one of the base plates 3, and a hole 53 is provided in the circumferential surface of the joint element 52. The hole 53 receives a ball 54 (such as a steel ball), which has a diameter slightly greater than the inner diameter of the hole 53. A split elastic ring 56 having a projecting nose 55 is fitted onto the surface of the joint element 52, so that the nose 55 and the hole 53 of the joint element 52 restrict the displacement of the ball 54, the ball 54 hence has one portion thereof protruding inwardly from the hole 53 of the joint element 52, while the other portion thereof protruding outwardly to be restricted by the nose 55 of the elastic ring 56. The stop plate 6 is provided at one side of the ratchet 5 between the base plates 3. A fastener 63 (a pin is used in this embodiment) secures the stop plate 6 in one of the through holes 41 of the base 4. One end of the stop plate 6 has a protruding stop element 61 which may engage with the teeth of the ratchet 5. Both sides of the stop element 61 are provided with trigger portions 62. The other end of the stop plate 6 is provided with the urging element 7, which is also provided between the base plates 3. The urging element 7 has a spring 71 and a steel ball 72, which are respectively disposed in two of the through holes 41 of the base 4, such that the steel ball 72 is urged against by the spring 71 for pushing the stop plate 6, so that the stop element 61 at the other end of the stop plate 6 may engage with the ratchet 5. An end 81 of the longitudinal rod 8 is inserted into the longitudinal hole 51 of the joint element 52. An end 81 of the longitudinal rod 8 is provided with an annular slot 82 for retaining the ball 54 in order to prevent the longitudinal rod 8 from sliding axially. The other end 83 of the longitudinal rod 8 is provided with a connecting section for receiving screws (not shown). The rotary element 9 is fitted onto the outer surface of the joint element 52. The rotary element 9 has a rotary end 91 and a connecting end 92. The rotary end 91 is provided with an axially oriented polygonal hole. Diminishing grooves 912 are provided in the center of two opposite sides of the square hole 911, and a hole 921 is provided in the connecting end 92 of the rotary element 9. The hole 921 is fitted onto the joint element 52 rather tightly, and it communicates with the polygonal hole in the rotary end 91. When the longitudinal rod 8 is inserted into the longitudinal hole 51 of the joint element 52, the annular slot 82 of the longitudinal rod 8 urges against the ball 54 with its side, and the elastic ring 56 which expands outwardly maintains tight contact with the inner surface of the hole 921 of the rotary element 9. At the same time, the inner surface of the hole 921 of the rotary element 9 restricts the expansion of the elastic ring 56, so that the elastic ring 56 urges against the ball 54 again, and the ball 54 is then in tight contact with the longitudinal rod 8 within the longitudinal hole 51 of the joint element 52, preventing the longitudinal rod 8 from longitudinal displacement. The rotary element 9 then drives the longitudinal rod 8 via the polygonal hole of the rotary end 91.

By means of the above-mentioned structure, the rotational direction of the ratchet 5 is controlled by the stop plate 6 so that the ratchet 5 may perform clockwise or counter-clockwise rotation as desired.

Figure 5A:
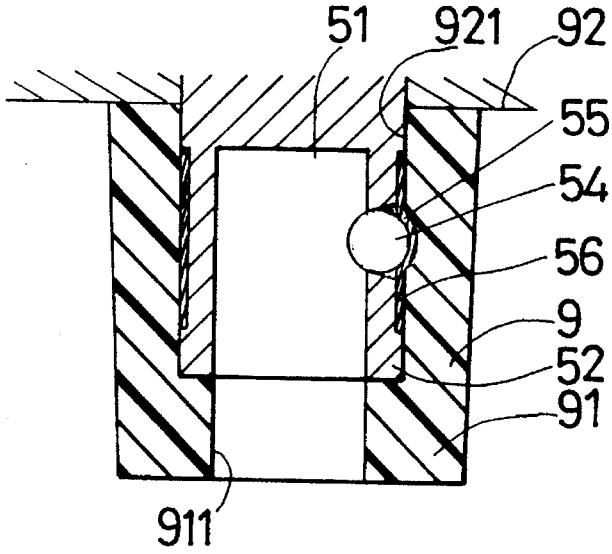
FIG. 5A is a sectional view taken along line V—V of FIG. 4, showing the rotary element, the joint and the longitudinal rod before assembly.
Figure 5B:
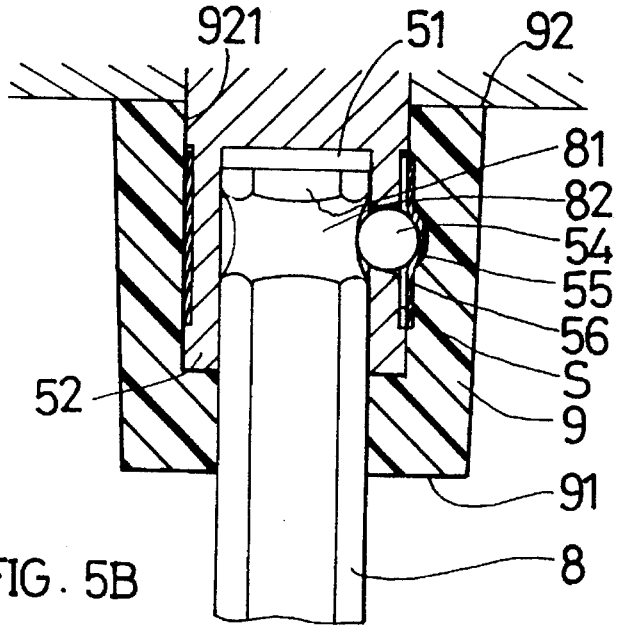
FIG. 5B is a sectional view taken along line V—V of FIG. 4, showing the rotary element, the joint and the longitudinal rod after assembly.
Figure 6B:
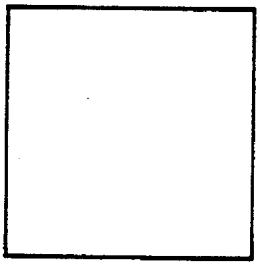
FIGS. 6A to 6E are views showing various embodiments of the polygonal hole of the rotary end of the rotary element.
Figure 6A:
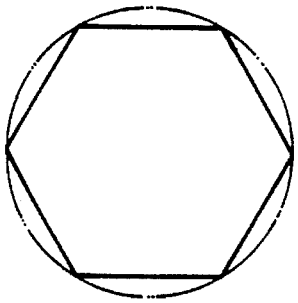
Figure 6C:
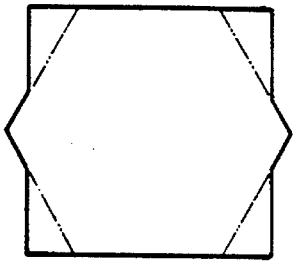
Figure 6E:
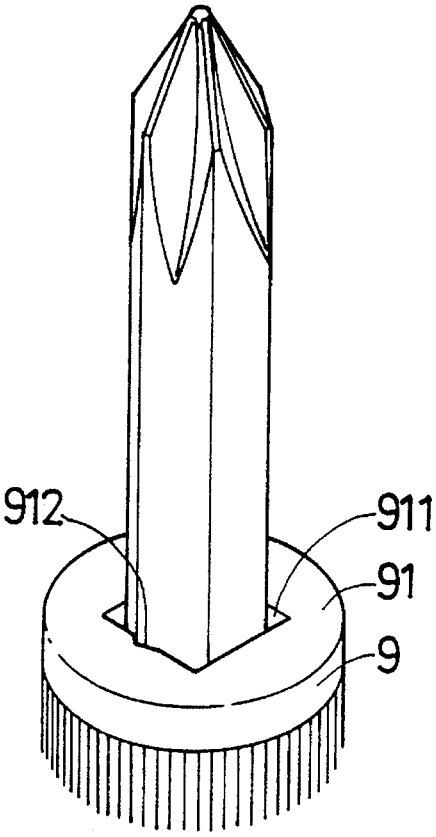
Figure 6D:
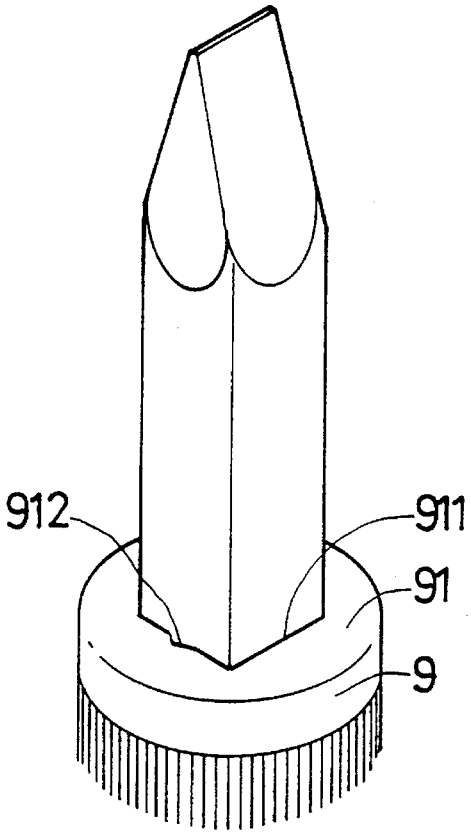

The rotary element 9 according to the first preferred embodiment of the present invention is tightly fitted onto the joint element 52 of the ratchet 5. The functions of the rotary element 9 are as follows:

1. As shown in FIG. 5A, the inner surface of the hole 921 of the rotary element 9 urges against the ball 54 so that the ball 54 projects on the outside of the inner surface of the joint element 52, enabling the inner surface of the hole 921, the elastic ring 56 and the outer surface of the joint element 52 to be in contact with one another.
2. As shown in FIG. 5B, the longitudinal rod 8 is inserted with its end 81 into the longitudinal hole 51 of the joint element 52, so that the ball 54 is retained in the annular slot 82 of the longitudinal rod 8 for restricting the longitudinal displacement of the longitudinal rod 8. At this time, the ball 54 is urged against by the outer surface of the annular slot 82 to move outwardly; when the ball 54 displaces outwardly, the elastic ring 56 will be stretched to form a clearance S between the elastic ring 56 and the joint element 52, so that the elastic ring 56 is in tight contact with the inner surface of the hole 921. Besides, because the diameter of the hole 921 is fixed, the extent of the expansion of the elastic ring 56 is limited. Therefore, the elastic ring 5, which is subjected to its own elasticity and the urging force of the inner surface of the rotary element 9, urges inwardly against the ball 54 which is caused to displace. The ball 54 then comes into tight contact with the outer surface of the annular slot 82 again, increasing the frictional force between the ball 54 and the longitudinal rod 8, hence restricting the displacement thereof. In this way, after the longitudinal rod 8 is inserted into the joint element 52, the ball 54 and the elastic ring 56 urge against each other so that the rotary element 9, the joint element 52 and the longitudinal rod 8 securely unite as a whole.
3. As shown in FIG. 6, the configuration of the polygonal hole of the rotary end 91 of the rotary element 9 includes the diminishing grooves 912 in the center of the two opposite sides of the square hole 911; that is, a hexagon (FIG. 6A) and a square (FIG. 6B) are combined into a ten-sided hole with ten angles (FIG. 6C). The ten-side hole may accommodate a quadrilateral longitudinal rod (FIG. 6D) or a hexagonal one (FIG. 6E), without the need to provide two corresponding rotary elements for matching the shape of the longitudinal rod. And by means of the polygonal hole of the rotary element, a quadrilateral or hexagonal longitudinal rod may be rotated.

When just screwing in or screwing out a screw, and the resistance of the screw in the screw hole is less than the resilience of the spring 71 of the urging element 7, the user may simply hold the base plates 3 with one hand and turn the rotary element 9 with his fingers, bringing the longitudinal rod 8 to rotate quickly to screw in or out the screw.

Certainly, when the screw resistance is greater than the resilience of the spring 71, the user may directly turn the base plates 3 to utilize the ratchet 5 and the urging element 7 in completing the job. Because the rotational direction of the rotary element is the same as that of the longitudinal rod 8 turned by means of the base plates 3, the ratchet 5 and the urging element 7, it is not necessary to adjust the rotational direction of the ratchet 5 when shifting from one screwing action to another.

Due to the novel connection relationship among the rotary element, the joint element of the ratchet, and the longitudinal rod, the longitudinal rod may be secured in the longitudinal hole of the joint element of the ratchet while the rotary element is used to perform quick screwing actions, so that the longitudinal rod is urged by the ball to be in tight contact with the inner surface of the longitudinal hole. Hence, there will not be any vibration during operation, ensuring the linearity of the application axis and the firm tightening of the screws.

Figure 7:
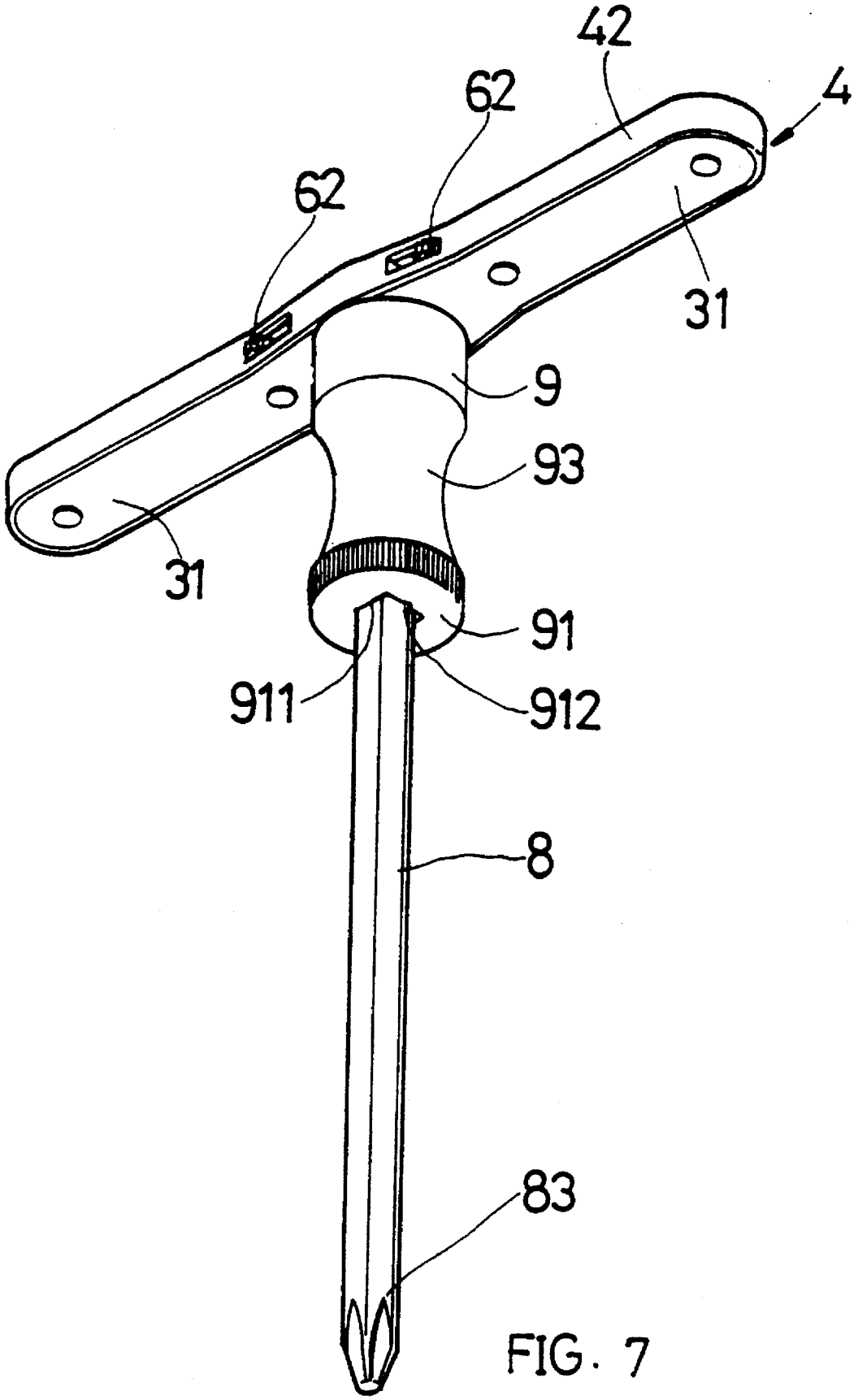
FIG. 7 is a perspective view of a second preferred embodiment of the present invention after assembly.

It is obvious that the present invention may be modified in a number of ways. FIG. 7 shows another preferred embodiment of the present invention. A curved surface 93 is provided on the circumferential surface of the rotary element 9. The curved surface 93 provided near the base plates 3 forms a force receiving surface for the user to grip thereonto. Aside from being comfortable to hold, the curved surface 93 also provides the user with a better pivot point when applying force, enhancing the output of torque.

Alternatively, a through hole 58 may be provided in the annular surface of the elastic ring 57 to achieve the similar function of restricting the displacement of the ball 54.

Furthermore, a hexagonal hole 94 or a square hole may be provided in the rotary end 91 of the rotary element 9 for bringing the longitudinal rod 8 to rotate.

In addition, any coarse or rough surface, such as corrugated strips, bossed surface, or a covering, may be provided on the circumferential surface of the rotary element 9 to increase the frictional force when turning the rotary element, hence enhancing work efficiency.

Figure 8:
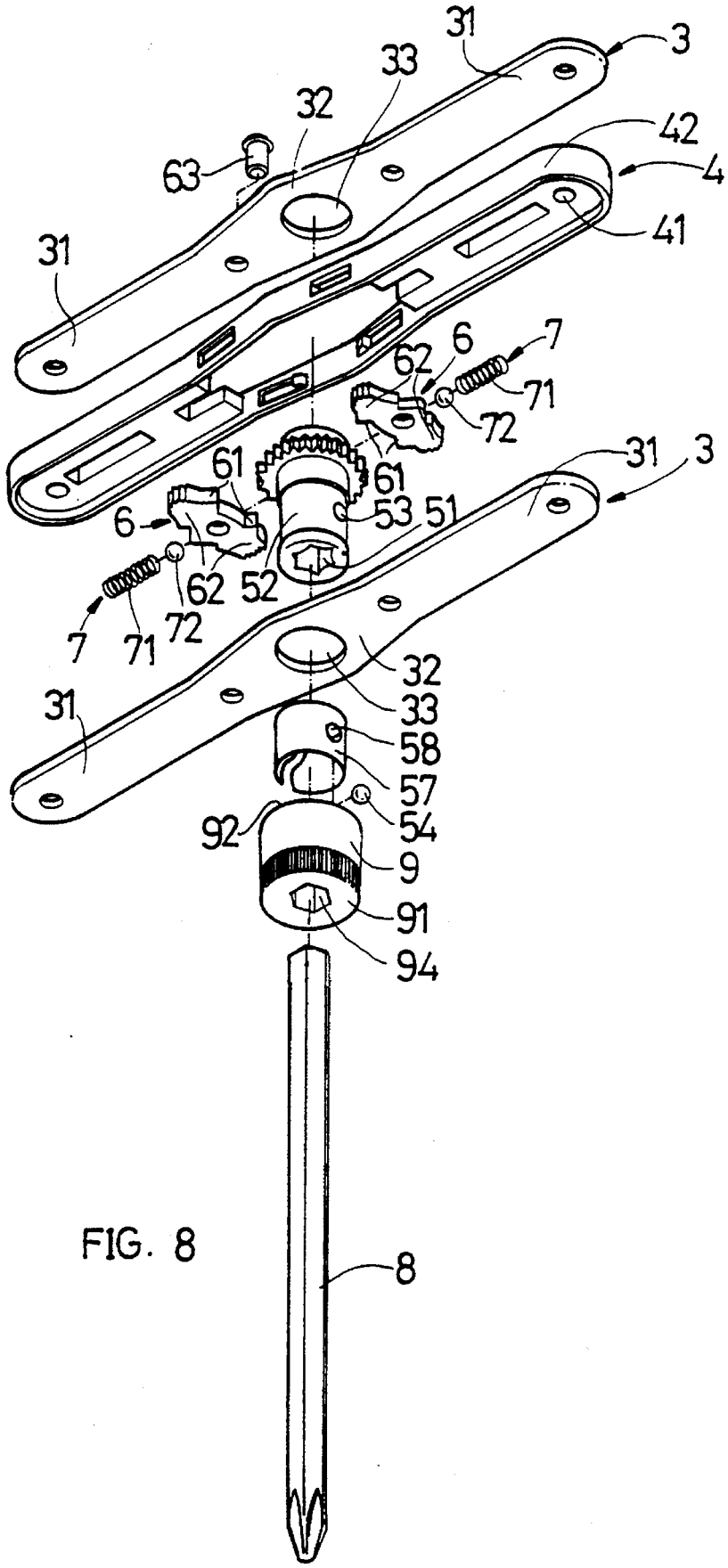
FIG. 8 is an exploded perspective view of a third preferred embodiment of the present invention.

FIG. 8 shows a third preferred embodiment of the present invention, in which two stop plates 6 and two urging elements 7 are respectively provided on either side of the ratchet 5 so that the ratchet 5 may perform forward or backward rotation.

Figure 9:
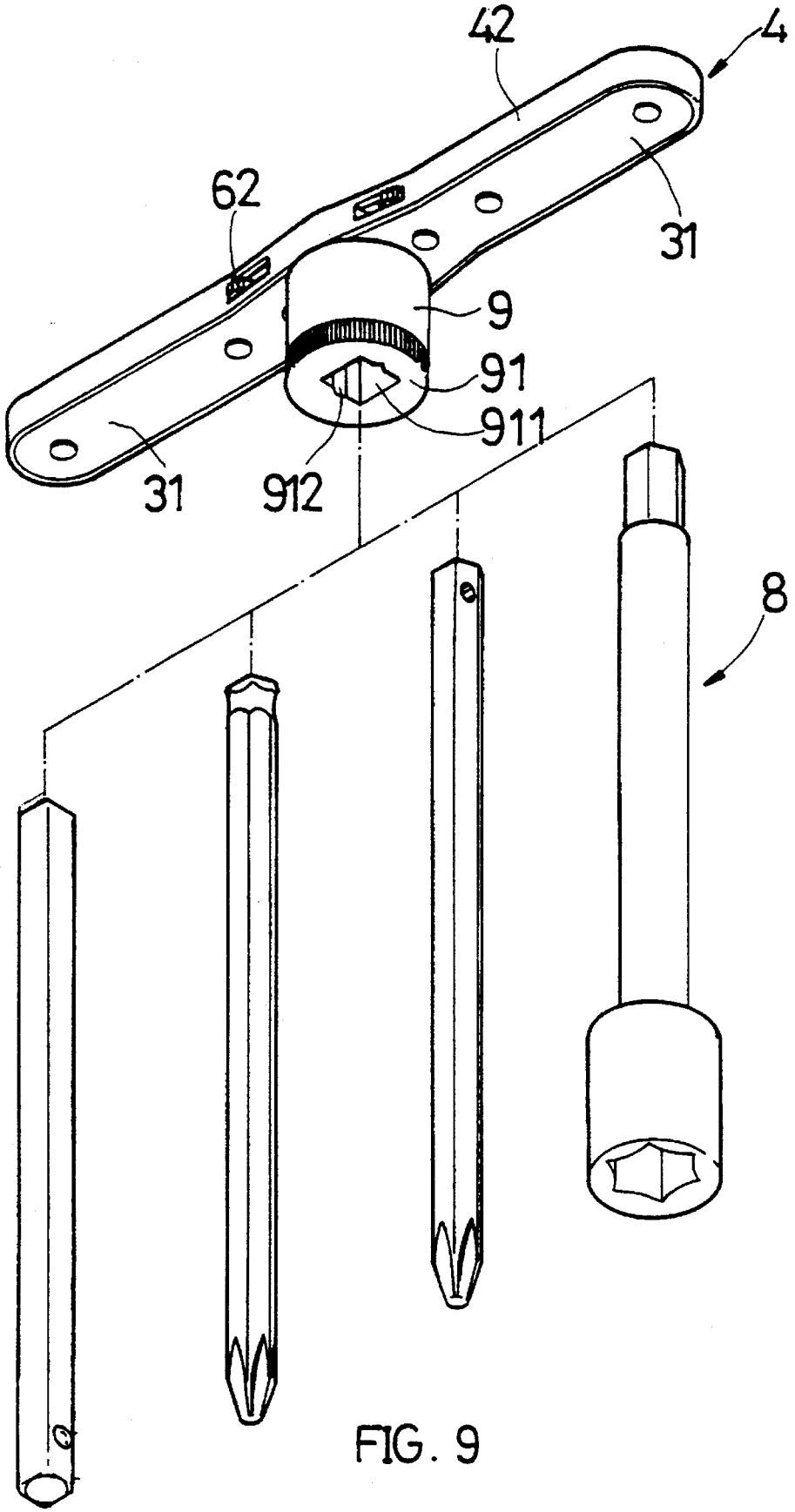
FIG. 9 is a schematic view showing the ratchet hand tool of the present invention and a multiplicity of longitudinal rods.

Moreover, as shown in FIG. 9, the longitudinal rod 8 may be in the form of a screwdriver or a socket, or any hand tool that requires turning in doing a job.

Although the present invention has been illustrated and described with reference to the preferred embodiment thereof, it should be understood that it is in no way limited to the details of such embodiment but is capable of numerous modifications within the scope of the appended claims.

What is claimed is:

1. A ratchet hand tool, comprising:

a handle assembly comprising:

i) two base plates, each of said base plates having a generally circular through hole; and, ii) a base disposed between said two base plates and attached to said base plates with one of said base plates arranged above the base and the other of said base plates below the base;

b) a ratchet disposed in said generally circular holes of said base plates, said ratchet having a joint element extending outwardly through said generally circular hole in one of said base plates, a hole being provided in a circumferential surface of said joint element at a predetermined position said hole containing a ball which has a diameter slightly greater than a diameter of said hole, and a split elastic ring located on the circumferential surface of said joint element;

c) at least one stop plate disposed at one side of said ratchet, said stop plate being located between said base plates and having at least one projecting stop element for engagement with said ratchet, said stop element having two trigger portions;

d) at least one biasing element for each stop plate being disposed between said base plates for biasing said stop plate so that said stop element engages said ratchet;

e) a longitudinal rod inserted into said joint element of said ratchet so as to rotate therewith; and, f) a rotary element attached to said joint element of said ratchet, so as to be rotatable with respect to said handle assembly, and having an outer gripping surface, a rotary end provided with a polygonal hole, a connecting end provided with a fitting hole fitted onto said joint element and communicating with said polygonal hole of said rotary end, so that when said longitudinal rod is inserted into said joint element, an outer surface of said longitudinal rod bears against said ball and said elastic ring which is caused to expand into tight contact with an inner surface of said fitting hole of said rotary element, whereby said inner surface of said rotary element restricts the expansion of said elastic ring so that said elastic ring urges said ball into tight contact with said longitudinal rod thereby restricting longitudinal displacement of said longitudinal rod, whereby said rotary element may be manually rotated relative to said handle assembly in at least one direction so as to rotate said longitudinal rod.

2. A ratchet hand tool as claimed in claim 1, wherein said base has a flange extending in opposite directions from a peripheral rim thereof for enveloping said base plates.

3. A ratchet hand tool as claimed in claim 1, wherein said ratchet is provided with two stop plates and two biasing elements.

4. A ratchet hand tool as claimed in claim 1, wherein said elastic ring has a projecting nose portion.

5. A ratchet hand tool as claimed in claim 1, wherein said elastic ring is provided with a through hole.

6. A ratchet hand tool as claimed in claim 1, wherein an end of said longitudinal rod inserted into said longitudinal hole of said joint element has an annular slot for receiving said ball.

7. A ratchet hand tool as claimed in claim 1, wherein said gripping surface of said rotary element comprises a curved surface with a grip portion.

8. A ratchet hand tool as claimed in claim 1, wherein said polygonal hole has a substantially square cross-sectional configuration with grooves formed in two opposite sides of the square hole.

* * * * *